US005348495A

United States Patent [19]

Kasden

[11] Patent Number: 5,348,495

[45] Date of Patent: Sep. 20, 1994

[54] ELECTRICAL CORD PLUG LOCK ASSEMBLY

[76] Inventor: Larry R. Kasden, 1212 Andover Rd., El Cajon, Calif. 92019

[21] Appl. No.: 141,044

[22] Filed: Oct. 26, 1993

[51] Int. Cl.[5] ..... H01R 13/62

[52] U.S. Cl. ..... 439/371; 439/373

[58] Field of Search ..... 439/358, 372, 367, 369, 439/371, 373

[56] References Cited

U.S. PATENT DOCUMENTS

| | | | |
|---|---|---|---|
| 2,240,050 | 4/1941 | Nuebling | 439/367 X |
| 4,457,571 | 7/1984 | Lavine et al. | 439/369 |
| 5,011,427 | 4/1991 | Martin | 439/373 |
| 5,049,086 | 9/1991 | Slauen | 439/373 X |

*Primary Examiner*—Khiem Nguyen
*Attorney, Agent, or Firm*—Charles C. Logan, II

[57] ABSTRACT

An electrical cord plug lock assembly having a special electrical socket face plate with a pair of laterally spaced locking brackets extending outwardly from its front surface adjacent the opposite sides of the socket aperture. A base clamp member has a locking arm pivotally secured to its respective left and right ends. The front end of the locking arms have structure for detachably securing them to the respective locking brackets on the front of the electrical socket face plate. A top clamp member is detachably secured to the top surface of the base clamp member and it functions to grip an electrical cord there-between. The electrical plug lock assembly prevents accidental removal of the electrical plug from the electrical socket.

8 Claims, 1 Drawing Sheet

ELECTRICAL CORD PLUG LOCK ASSEMBLY

BACKGROUND OF THE INVENTION

The invention relates to electrical sockets into which the electrical plug on the end of an electrical cord is inserted.

One of the problems that exists regarding electrical sockets in the home is the fear that a child will pull an electrical plug out of a socket and receive an electrical shock. Also there is considerable concern that a child will either stick their finger or another object into the open socket.

There have been different structures invented to prevent this problem and one of the most commonly seen is the flat plastic plug cover having fingers on its rear surface that are removably received into the socket to hide them from the view of a child. There have been other very complicated devices invented to prevent a child from gaining access to the open socket. Most of these cover both the sockets so that it is necessary to completely remove the device before a plug can be inserted into one of them.

A second problem that exists relates to the plug on the end of an electrical cord of a computer. Sometimes the plug can be accidently removed while the computer is in use by the user or someone else. When this occurs the data that has been put into the computer can be lost making it necessary to do the job over a second time.

Another problem that exists is the inconvenient accidental removal of the plug of a household appliance, such as a vacuum cleaner. This is a frequent occurrence while a person using a vacuum cleaner is moving around a room while cleaning. It is annoying and bothersome to periodically have to reinsert the plug each time it is pulled free.

An additional area of concern is in industrial type workshops such as machine shops where it is important that the machinery stay plugged in and not be accidently unplugged.

It is an object of the invention to provide a novel electrical cord plug lock assembly that can be used as a child-proofing device for electrical plugs which are plugged into an electrical wall socket.

It is also an object of the invention to provide a novel electrical cord lock assembly that is economical to manufacture and market.

It is another object of the invention to provide a novel electrical cord plug lock assembly that can be easily installed or removed without requiring the use of tools.

It is a further object of the invention to provide a novel electrical cord plug lock assembly that will prevent accidental removal of the electrical cord plug.

SUMMARY OF THE INVENTION

The electrical cord plug lock assembly has been designed as a multi purpose device. It will prevent a child from removing a plug from the electrical socket of the wall outlet, which would leave the electrical socket slots open for a child to put something into them causing an electrical shock to the child. It will also hold the electrical plug tightly in the electrical socket so that a child cannot put a finger/or object between the electrical socket and a loose plug. This will prevent electrical shock to a child by keeping the prongs of a plug inaccessible. The device will allow convenient removal and reinsertion of the plug by an adult without tools so that repeated use would not be inconvenient.

A second use for the electrical cord plug lock assembly is as a computer safety device to prevent accidental removal of the computer plug while the computer is in use. A computer plug can easily be inadvertently knocked out of the electrical wall outlet by the user. The plug lock assembly prevents this from occurring.

A third use for the electrical cord plug lock assembly is to prevent the inconvenient accidental removal of household appliance plugs. For example, a vacuum cleaner plug can easily be inadvertently pulled from a wall outlet while in use.

A fourth use for the electrical cord plug lock assembly is in industrial type work shops such as machine shops where it is important that machinery stay plugged in and not be accidentally unplugged.

A typical electrical wall outlet has two sockets, a top and bottom one. Each plug lock assembly will lock one electrical plug into one electrical socket. This will allow one socket to have a plug inserted and locked and leave the other socket accessible for convenient use. The unused socket would then have a plastic safety device inserted into it such as are readily available in the market place. Both the top and bottom sockets of the electrical wall socket can be in use and locked at the same time with the use of two plug lock assemblies.

The electrical cord plug lock assembly has three basic components, a special electrical socket face plate, a base clamp member and a top clamp member. The electrical socket face plate has laterally spaced locking brackets extending from the front surface thereof and they are positioned on the opposite sides of the socket apertures. The base clamp member has a locking arm pivotally secured to its respective left and right ends and these locking arms have a locking flange on their front ends that may be detachably secured to the respective locking brackets. The top clamp member is telescopically removable from the base clamp member so that they can be attached to the electrical cord immediately behind the electrical plug.

DESCRIPTION .OF THE PREFERRED EMBODIMENT

Figure 1:
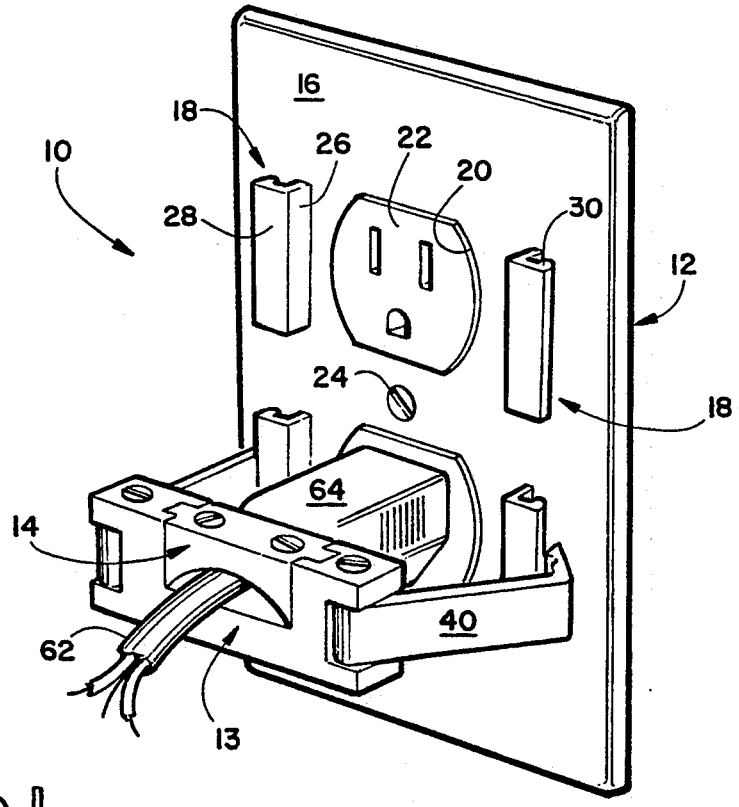
FIG. 1 is a front perspective view illustrating the novel electrical cord plug lock assembly.
Figure 2:
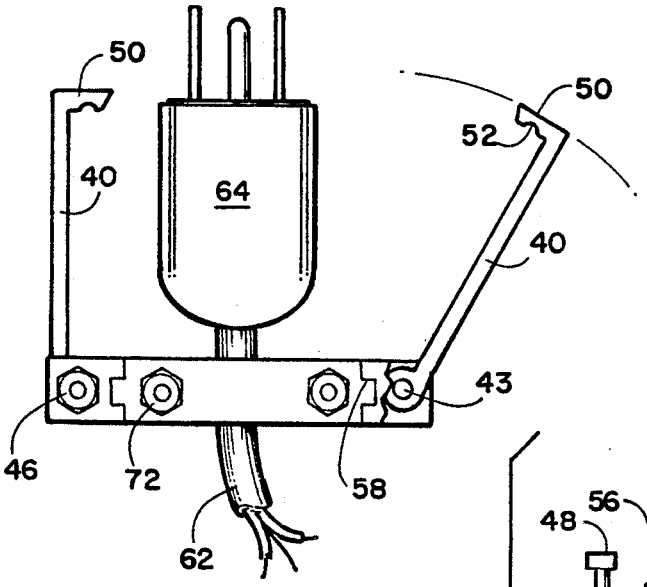
FIG. 2 is a bottom plan view showing the base clamp member and top clamp member secured to the electrical cord adjacent the electrical plug.
Figure 3:
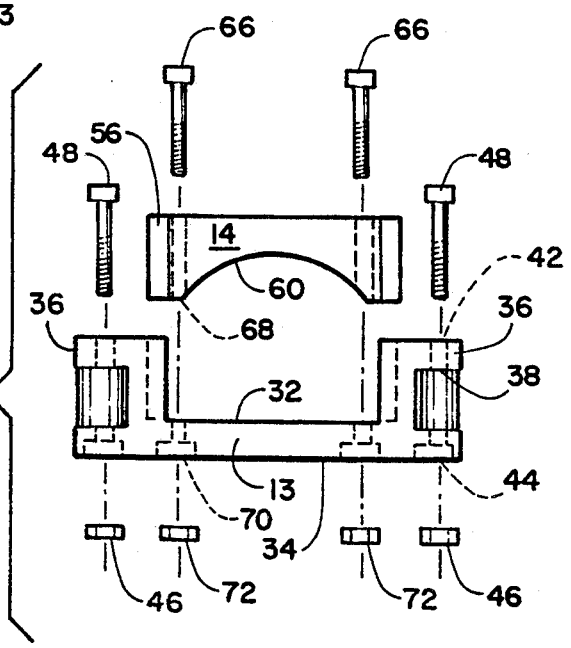
FIG. 3 is an exploded front elevation view of the base clamp member and top clamp member.

The novel electrical plug lock assembly will now be described by referring to FIGS. 1–3 of the drawing. The plug lock assembly is generally designated numeral 10. Its main components are electrical socket face plate 12, base clamp member 13, and top clamp member 14.

Electrical socket face plate 12 has a front surface 16 with a pair of laterally spaced locking brackets 18 extending outwardly therefrom. It has a pair of socket apertures 20 that fit over electrical sockets 22. A screw 24 tightens the face plate to the electrical socket unit. The locking brackets 18 each have an outwardly extending wall 26 with a flange 28 extending transversely therethrough. The rear surface of flange 28 has a linearly extending ridge or bead 30 thereon.

Base clamp member 13 has a top surface 32 and a bottom surface 34. A tower portion 36 extends upwardly from its top surface adjacent its left end and its right end. Tower portions 36 have an arm recess 38 for receiving the rear end of the respective locking arms 40. Vertical bore holes 42 pass through tower portion 36 and communicate with recesses 44 in bottom surface 34 that are configured to receive nuts 46. Screws 48 pass through the aligned bore 42 of tower portion 36 and bore 43 of the rear end of locking arm 40. The front end of locking arms 40 have a locking flange 50 whose rear surface has a groove 52 that snaps over ridge 30 of the locking bracket to lock it securely in position.

Top clamp member 14 has a tongue 56 extending outwardly from its left and right ends that telescopically slide into keyways 58 in base clamp member 13. Top clamp member 14 has a concave bottom surface 60 that is tightened down onto electrical cord 62 to capture electrical plug 64. Screws 66 pass through bore hole 68 and communicate with recesses 70 in the bottom surface 34 of clamp member 13. Recesses 70 are configured in the shape of nuts 72.

What is claimed is:

1. An electrical cord plug lock assembly comprising:

an elongated base clamp member having a top surface, a bottom surface, a left end and a right end;

a top clamp member having a top surface, a bottom surface, a left end and a right end;

means for detachably securing an electrical cord between the bottom surface of said top clamp member and the top surface of said base clamp member;

a pair of elongated locking arms each having a front end and a rear end;

means for pivotally securing the rear ends of said locking arms to the respective left and right ends of said base clamp member;

an electrical socket face plate having a front surface and at least one socket aperture; and means for detachably securing the front ends of said locking arms to the front surface of said electrical socket face plate.

2. An electrical cord plug lock assembly as recited in claim 1 wherein said means for detachably securing the front ends of said locking arms to the front surface of said electrical socket face plate comprises:

a pair of laterally spaced locking brackets that are mounted on the front surface of said electrical socket face plate, said locking brackets being located on the opposite sides of said socket aperture.

3. An electrical cord plug lock assembly as recited in claim 2 wherein said locking brackets each have an outwardly extending wall that has a front end, a flange extends laterally from the front end from each of said walls.

4. An electrical cord plug lock assembly as recited in claim 3 wherein each of said flanges has a front surface and a rear surface and each has a ridge extending from said rear surface toward the front surface of said electrical socket face plate.

5. An electrical cord plug lock assembly as recited in claim 1 wherein said base clamp member has a pair of laterally spaced tower portions extending upwardly from its top surface adjacent its respective left and right ends, each of said tower portions has an arm recess that receives the rear end of said respective locking arms.

6. An electrical cord plug lock assembly as recited in claim 5 wherein each of said tower portions have a vertically oriented keyway that face each other.

7. An electrical cord plug lock assembly as recited in claim 6 wherein said top clamp member has a tongue extending from its left and right ends that are matingly received in the respective keyways of said tower portions.

8. An electrical cord plug lock assembly as recited in claim 7 wherein said top clamp member has a concave bottom surface.

* * * * *